US007775899B1

(12) United States Patent
Cannon

(10) Patent No.: US 7,775,899 B1
(45) Date of Patent: Aug. 17, 2010

(54) METHOD AND APPARATUS FOR EXECUTING REPEATABLE GOLF SWINGS

(76) Inventor: Thomas Calvin Cannon, 1010 Eastbourne Dr., La Plata, MD (US) 20646

( * ) Notice: Subject to any disclaimer, the term of this patent is extended or adjusted under 35 U.S.C. 154(b) by 0 days.

(21) Appl. No.: 12/584,068

(22) Filed: Aug. 31, 2009

Related U.S. Application Data

(63) Continuation-in-part of application No. 12/382,766, filed on Mar. 24, 2009.

(51) Int. Cl.

| | |
|---|---|
| ***A63B 69/36*** | (2006.01) |
| ***F41C 27/00*** | (2006.01) |
| ***G01C 9/28*** | (2006.01) |
| ***G01C 9/24*** | (2006.01) |

(52) U.S. Cl. ..... 473/226; 473/238; 473/241; 33/334; 33/372; 33/373; 33/379; 33/389

(58) Field of Classification Search ..... 473/241, 473/219, 226, 238, 242, 131, 324, 244–248; 33/334, 347, 372, 373, 379, 388, 389, 390
See application file for complete search history.

(56) References Cited

U.S. PATENT DOCUMENTS

| | | | | | |
|---|---|---|---|---|---|
| D180,624 | S | * | 7/1957 | Souter | D10/62 |
| 2,919,491 | A | * | 1/1960 | Darrell et al. | 33/334 |
| 2,923,552 | A | * | 2/1960 | Sundberg | 473/238 |
| 3,225,451 | A | * | 12/1965 | Olexson et al. | 33/347 |
| 4,079,520 | A | * | 3/1978 | Davis | 473/241 |
| 4,179,125 | A | * | 12/1979 | Cone et al. | 473/241 |
| 4,295,279 | A | * | 10/1981 | Sienknecht | 33/334 |
| 4,425,784 | A | * | 1/1984 | D'Gerolamo | 72/459 |
| 4,580,350 | A | * | 4/1986 | Fincher | 33/334 |
| 4,815,743 | A | * | 3/1989 | Meeker et al. | 473/257 |
| 4,829,676 | A | * | 5/1989 | Waldron | 33/372 |
| 4,888,875 | A | * | 12/1989 | Strother | 33/347 |
| 4,908,949 | A | * | 3/1990 | Jaccard | 33/334 |
| 4,913,441 | A | * | 4/1990 | Freer | 473/220 |
| 4,934,706 | A | * | 6/1990 | Marshall | 473/241 |
| 5,127,167 | A | * | 7/1992 | Kennedy | 33/370 |
| 5,431,391 | A | * | 7/1995 | Tracey | 473/257 |
| 5,467,991 | A | * | 11/1995 | White et al. | 473/220 |
| 5,474,299 | A | * | 12/1995 | Romano | 473/212 |
| 5,509,657 | A | * | 4/1996 | Guthry | 473/241 |
| 5,538,251 | A | * | 7/1996 | Harper | 473/229 |
| 5,632,484 | A | * | 5/1997 | Lambert | 473/241 |
| 5,665,006 | A | * | 9/1997 | Pellegrini | 473/220 |
| 5,755,623 | A | * | 5/1998 | Mizenko | 473/241 |
| 5,954,592 | A | * | 9/1999 | Laffer et al. | 473/220 |
| 6,059,668 | A | * | 5/2000 | Marley, Jr. | 473/220 |
| 6,209,371 | B1 | * | 4/2001 | Guinn | 72/31.05 |

(Continued)

*Primary Examiner*—Sebastiano Passaniti

(57) ABSTRACT

The present invention helps golfers consistently execute the ideal golf swing. To consistently execute the ideal swing, golfers must consistently align the shafts of their clubs at the ideal angle with respect to the horizontal at setup, prior to executing the swing. The present invention helps golfers set their clubs at the ideal angle by attaching an angle indicating device to the club that indicates the angle of the club with respect to the horizontal. The preferred embodiment of the angle indicating device is a small, lightweight circular bubble level, that has angle markings around its edge, and quickly clips onto an off of the golf club. The angle indicating device is sufficiently small and lightweight that it does not affect the golfers swing. The same device may be used on different golf clubs to show the desired angle for the club in use.

1 Claim, 4 Drawing Sheets

U.S. PATENT DOCUMENTS 6,346,050 B1 * 2/2002 Larson ..... 473/270
6,468,166 B1 * 10/2002 Spitzer ..... 473/241
6,558,267 B2 * 5/2003 Novosel, Sr. ..... 473/232
6,645,084 B1 * 11/2003 Dayton ..... 473/230
6,814,672 B2 * 11/2004 Spitzer ..... 473/241
6,945,875 B2 * 9/2005 Gauer ..... 473/270

* cited by examiner 1
2
3
4
5
6
7
8
9
10
11
12

METHOD AND APPARATUS FOR EXECUTING REPEATABLE GOLF SWINGS

Continuation-in-part of prior application Ser. No. 12/382,766 with filing date Mar. 24, 2009; and Art Unit 3711; and Confirmation No. 3884; and replacing the prior application in its entirety.

This invention relates to a way of helping golfers develop reliable golf swing that consistently strike golf balls to produce the desired results. More particularly, this invention relates to equipping golf clubs with a device, referred to as a shaft alignment indicator, that indicates the club's actual shaft angle relative to the ideal shaft angle, thereby allowing golfers to adjust the actual shaft angle until it coincides with the ideal shaft angle. The small, lightweight, shaft alignment indicator quickly clips onto and off of the golf club shaft, allowing the device to be used in both practice and competition. The device consists of a bubble tube, of the type commonly employed in carpenter levels, affixed to a clip that snaps onto the golf shaft, at an angle equal to the ideal shaft angle.

BACKGROUND OF THE INVENTION

Numerous training aids and golf club designs have been developed to help golfers develop and consistently replicate the ideal swing. Such training aids have generally been of three types; those that attempt to control the motion of the golfer's body; those that attempt to control the motion of the golf club; those that help golfers direct the club along an ideal path. The present invention fits into the later category. The first two categories will be reviewed first.

Meeker and Crouch, U.S. Pat. No. 4,815,743 disclose a large circular plate, termed a member, mounted on a support structure at an angle corresponding to the ideal swing plane. The golfer sticks his head through an opening in one edge of the plate and practices executing his golf swing without contacting the plate. Besides the size, expense and unwieldiness of this structure, it does little to control the actual movement of the golf club and does not specify how to determine the ideal swing plane.

Romano, U.S. Pat. No. 5,474,299 discloses a system of linkages and a rotor that connects to the golfer's hand and rotates as the golfer executes his or her swing. This large mechanism is complex and does not control the important link between the club grip and club head. Further, the disclosure does not specify how to align the rotor to the ideal swing plane. Numerous other inventions that attempt to control body motion fail to address the last, critical linkage in the complex system that starts at a golfer's feet and ends at the point where the club contacts the ball, the golf club itself. This is why so much attention has been devoted to the second category of training aids, those that attempt to control the golf club.

Harper, U.S. Pat. No. 5,538,251 discloses a rotation training structure that interconnects between a vertical support structure and the golf club that purports to guide the club through a perfect swing plane. However, the inherent flexibility in the large system of mechanical linkages prevents precise control of the swing plane, whether or not it is ideal.

Dayton, U.S. Pat. No. 6,645,084 B1 discloses a swing training device consisting of a large free-spinning wheel that attaches near the head of the golf club and makes contact with the ground at the moment of contact with the ball. This system purports to help users improve timing and release of hands, but actually inhibits the type of ball striking that compresses the ball between the turf and club face that is universally recommended for irons. Further, the added weight of the system disrupts normal feel of the golf club. No training system that attempts to control the motion of the golf club works for all users. They all suffer from the disadvantages that the mechanisms, rather than the golfer, control the motion of the club and the golfer's experience with the system is different than the real-world without it. Shortcomings of these systems have led to the proliferation of training aids that attempt to influence the club to follow the ideal swing plane, rather than directly control the club's motion.

Novosel, U.S. Pat. No. 6,558,267 B2 discloses a hinged training club claimed to act substantially like a conventional golf club in every way, and whose hinge breaks when the user executes a flawed swing. An advantage of this club is that it can be used both on the practice range and on a real golf course, but no real golfer wants to run the risk of the hinge breaking during a real golf swing, turning a bad swing into a catastrophic swing. Further, this system does not allow the golfer to practice with his or her own clubs.

Gauer, U.S. Pat. No. 6,945,875 B2 discloses a golf training device that includes a ball alignment marker and a template that identifies a preferred path of movement of the hand through a golf swing. The template also includes lines that identify the preferred orientations of the club face during the swing. The major shortcoming of this system and numerous similar systems is that they do not address the mechanics of actually making the club face follow the desired path and they do not account for the vertical motion of the club head through the ball and into the turf.

Numerous training aids have been invented that employ lasers that provide feedback on the orientation of the club shaft during the swing. For example, Freer, U.S. Pat. No. 4,913,441 discloses a laser swing training device that attaches to the butt of the golf club grip. The laser is intended to follow a path traced on a training mat on the ground, and in so doing help the golfer keep the club on an ideal swing The disadvantages of this and similar systems are that they can interfere with the golfer's hands and it is difficult to precisely align the laser with the golf shaft. Further, such systems direct the eyes of the golfer away from the ball during the golf swing. Variations on this system, including those disclosed by White and Burrus, U.S. Pat. No. 5,467,991, Pellegrini, U.S. Pat. No. 5,665,006, Lauffer and Parkinson, U.S. Pat. No. 5,954,592, and Marley, U.S. Pat. No. 6,059,668 all use similar approaches that suffer similar disadvantages.

Systems that influence the proper alignment of the golf club and its subsequent motion, while minimizing interference with the golfer, provide the greatest benefit to golfers. Lambert, U.S. Pat. No. 5,632,484 discloses a liquid-filled, transparent domed vial that attaches to the free-end of a golf club, and includes a bubble that indicates the angular alignment of the shaft. The problems with this system are that it is difficult to precise align the dome with the shaft to obtain accurate, consistent readings, and there is no unique position of the bubble in the dome that corresponds to the preferred shaft alignment to follow an ideal swing plane.

Spitzer, U.S. Pats. No. 6,468,166 B1 and No. 6,814,672 discloses systems that attach directly to the golf shaft, thereby eliminating the misalignment problem, that measure the lateral misalignment of the club face. The systems consist of alternate embodiments of curved bubble tubes, similar to the bubble tubes commonly found in carpenter level tools, but curved downward to keep the bubble at the top of the arc when the toe of the club is vertical. The major shortcoming of this system is that it does not provide the golfer with any new useful information and it ignores the more critical angle that the shaft makes with the ground. Golfers can readily perceive when the club face does not point toward the target. Further, Spitzer's inventions do not assure that the club face is square with the ball and pointing toward the target, but only that the toe of the club is vertical. Finally, the most critical shaft angle for starting and maintaining the club on the ideal swing plane is the angle that the shaft makes with the ground, which is not addressed by Spitzer's inventions.

Larson, U.S. Pat. No. 6,346,050 discloses a simple system for properly aligning the club shaft with the ground. The system includes a block bored with a plurality of holes that make different angles with the ground and a stake that the golfer can insert in the various holes. To use the system the golfer aligns the club shaft parallel to the shaft stuck in the block. The major problems with this system are that it relies on the user correctly judging when the two shafts are parallel, and it is not practical to use the system during actual play.

The unmet challenge is to devise a system that helps golfers properly align the golf shaft with the ground to start the club on the ideal swing plane, yet not disrupt normal use of the golf club.

Studies have shown that the best professional golf drivers create a 45-degree angle between the club shaft and the ground at ball impact. Ben Hogan, John Daly, and Tiger Woods all create a perfect 45-degree angle. Further, most professional golfers have a shaft angle of 45 to 47 degrees at impact while most amateurs have impact angles above 50 degrees. Such high shaft angles increase both ball spin and launch angle, leading to shorter drives and flight trajectories more susceptible to hooks and slices. Deviations from the 45 degree angle on the low side also have negative consequences. For example, professional golfers Fred Funk and Cory Pavin both have shaft angles close to 40 degrees at impact. Their drives tend to go straight, but short compared to other professional golfers. A device that helps golfers start their driver shafts on the ideal 45-degree swing angle, and helps maintain that plane angle throughout the swing would help both amateur and professional golfers. Such a device is the objective of the present invention.

The present invention is distinguished from prior art in that it directly measures the angle between the club shaft and ground, contains a built-in reference to the ideal club angle, and is small enough and sufficiently light weight to not affect the golf swing. Further, the device quickly clips onto and off the golf club, making it convenient to use during actual play.

BRIEF SUMMARY OF THE INVENTION

This invention is a method and apparatus for executing accurate, repeatable golf swings. The two components of the system are a clip that attaches to the golf club, and an angle-indicator, that mates with the clip and indicates the angle between the club shaft and the ground. The clip and angle-indicator constitute the alignment assembly. The longitudinal axis of the clip aligns precisely with the longitudinal axis of the shaft. The angle-indicator attaches to the clip in such a way that it provides a definitive indication when the longitudinal axis of the shaft matches the ideal angle with respect to the ground.

The clip is made of a spring material that allows it to be quickly attached to and detached from the golf club without damaging or scratching the shaft or the grip, and without permanently deforming the clip. Further, at the user's option, the clip may be installed or removed from the club by sliding the clip down the shaft axis toward the club head where the diameter of the shaft tapers down sufficiently to allow the clip to slip over the shaft without springing open the clip. By affixing the device directly to the club, with no play in the connection, the angle-indicator provides consistent, accurate readings of the shaft alignment angle.

The preferred embodiment of this invention uses a custom, circular bubble level device, that attaches to the clip so that circular bubble-level device lies in a vertical plane, and incorporates a plurality of marks around its periphery that indicate the angle between the shaft and the ground. Golfers use this invention by adjusting their golf club shafts until the bubble in the angle-indicating device is aligned with the appropriate mark on the angle-indicator for the club in use, thereby setting the club on the proper plane to begin their backswings.

DETAILED DESCRIPTION OF THE INVENTION

Figures 1A, 1B:
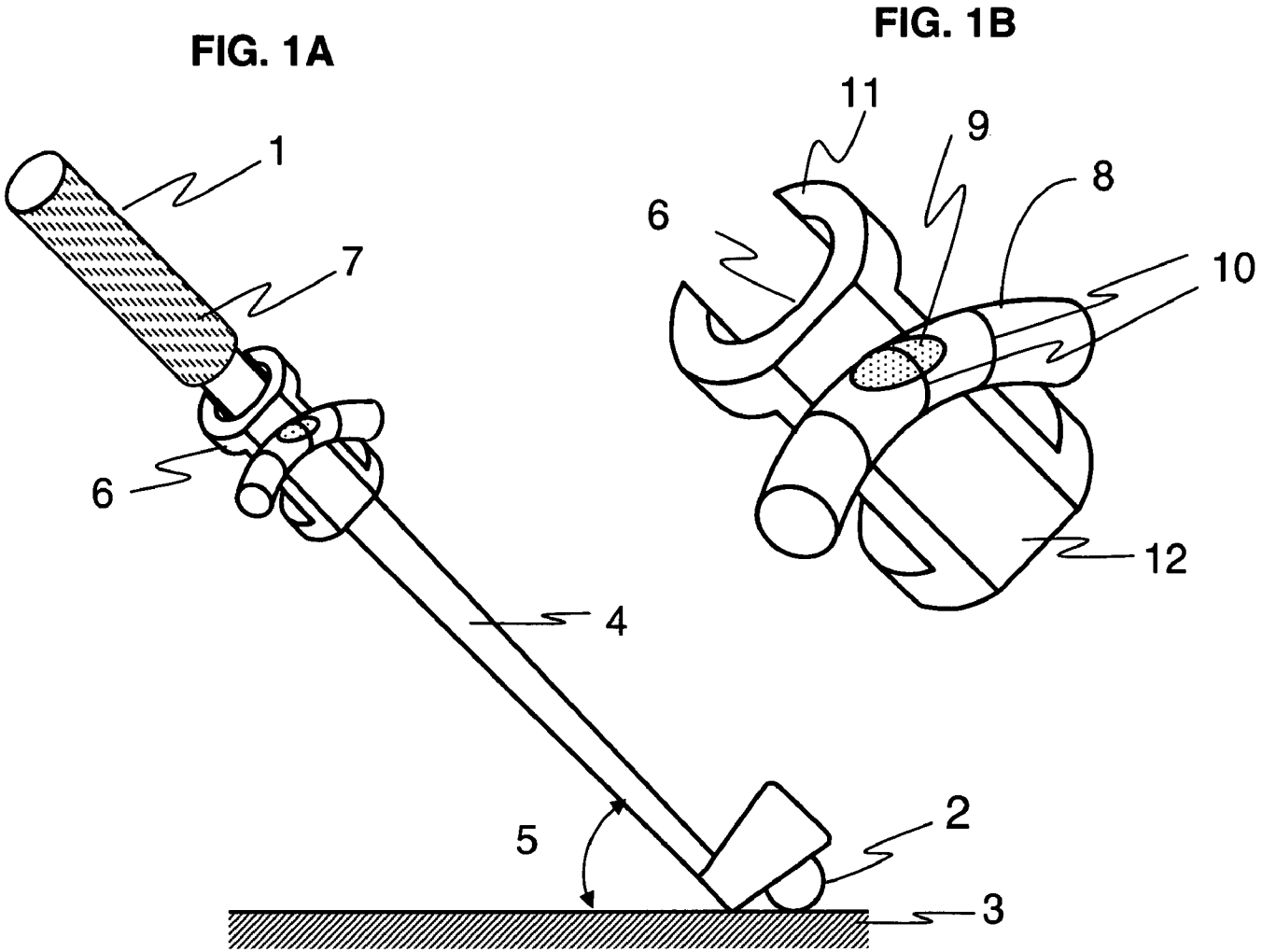
FIG. 1A is a schematic of the complete system, showing an exemplary embodiment of the alignment assembly, 6, mounted on a golf club, 1.
FIG. 1B shows the alignment assembly, 6, and its principal components.

FIG. 1A is a schematic of the entire system. The golf club, 1, is shown in the normal position as it addresses the ball, 2, lying on the ground, 3, prior to starting the swing. The club shaft, 4, makes an angle, 5, with the ground, 3. The alignment assembly, 6, attaches to the club, 1, by sliding it up along the tapered shaft, 4, until the alignment assembly, 6, creates an interference fit with the club, 1. The point where the interference fit occurs may be on the shaft, 4, or the grip, 7.

The ability to quickly install and remove the alignment assembly, 6, is important during actual play because the golfer may not want the alignment assembly, 6, to remain on the club shaft, 4, when he places the club, 1, back into his bag. At the user's option, the alignment assembly, 6, may be installed on the club shaft, 4, by either inserting the small end of the club shaft, 4, into the opening of the alignment assembly, 6, then sliding the alignment assembly, 6, up the club shaft, or simply snapping the alignment assembly, 6, directly onto the club, 1, at the point where the best fit occurs between the club, 1, and the spring arms, 11. The user has the same options for removing the alignment assembly, 6.

FIG. 1B is an enlargement of the alignment assembly, 6, that depicts its principal features, which include the clip, 12, spring arms, 11, angle indicator, 8, bubble, 9, and alignment marks, 10. To minimize its size, weight, and cost, the clip, 6, is an injection molded plastic such as Polycarbonate that possesses exceptional strength and elasticity. The spring arms, 11, are dimensioned such that they can spring open and securely latch onto the club, 1, without permanently deforming. The angle indicator, 8, resembles a bubble tube of the type commonly found in carpenter level tools, but is curved downward to form an arc of a circle. This downward curve allows the angle indicator, 8, to measure the angle, 5, which the club shaft 4, makes with the ground, 3. The bubble, 9, always comes to rest at the uppermost point of angle indicator, 8, thereby allowing the angle indicator, 8, to measure the angle, 5. This angle measurement capability allows the alignment assembly, 8, to be used with multiple clubs carried by the golfer by scribing the angle indicator, 8, with a plurality of alignment marks, 10, corresponding to the ideal alignment angle for each golf club. Alternatively, a mechanical or electronic inclinometer may be substituted for the fluid-filled angle indicator, 8.

The angle indicator, 8, is oriented on the mounting clip, 12, such that the bubble, 9, is centered on the angle marker, 10, designated for the club in use when the club shaft, 4, makes the ideal angle with the ground, 3, for the club in use.

Figure 2C:
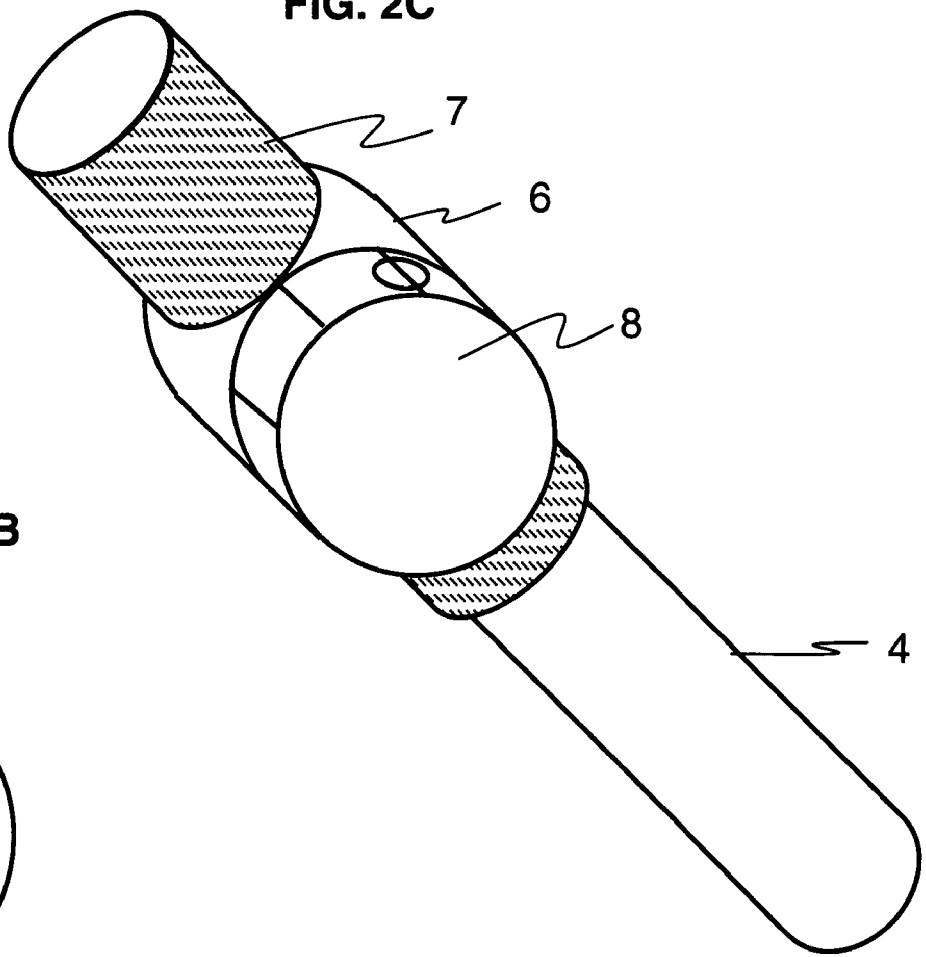
FIG. 2C shows the alignment assembly, 6, drawn in FIG. 2B mounted on a golf club.
Figure 2A:
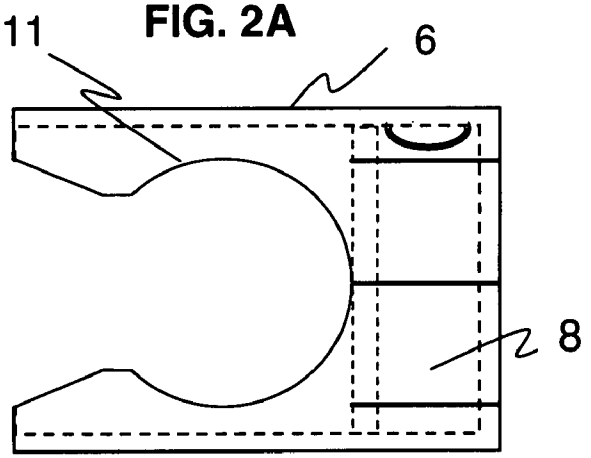
FIG. 2A shows an embodiment of the alignment assembly, 6, that integrates the clip, 12, with the angle-indicator, 8.

FIG. 2A shows an embodiment of the alignment assembly, 6, that integrates the clip, 12, with the angle-indicator, 8. This embodiment is easier to manufacture than the embodiment depicted in FIG. 1B because the spring arms, 11, are mere extension of the angle indicator, 8.

Figure 2B:
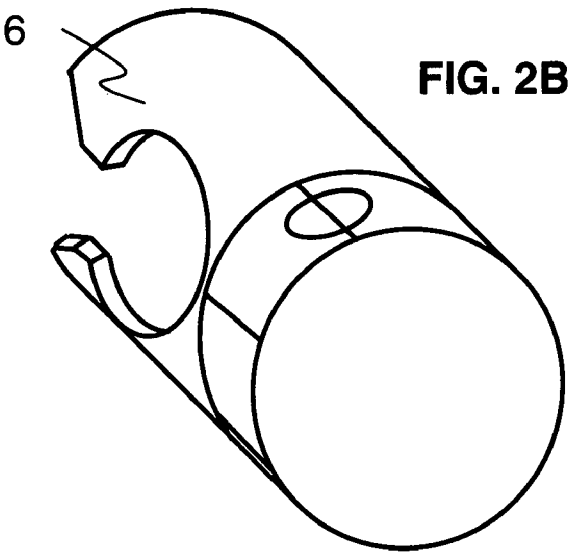
FIG. 2B is a perspective view of the alignment assembly, 6, depicted in FIG. 2A.

FIG. 2B provides a perspective view of the alignment assembly, 6, depicted in FIG. 2A.

FIG. 2C shows the alignment assembly, 6, depicted in FIG. 2B mounted on a golf club, 7. This mounting arrangement allows the alignment assembly, 6, to be conveniently clipped onto the golf club shaft, 4, or the grip, 7.

FIG. 3 A shows the preferred embodiment of the alignment assembly, 6, that orients the opening of the spring arms, 11, perpendicular to the swing plane of the shaft, 4. This perpendicular orientation makes the direction of the reactive force that is generated when the golf club impacts the ball perpendicular to the opening of the spring arms, 11, thereby eliminating any possibility of the alignment assembly, 6, coming off the golf club at impact. This embodiment permits the angle alignment assembly, 6, to be mounted to either the golf club shaft or grip.

Figure 3A:
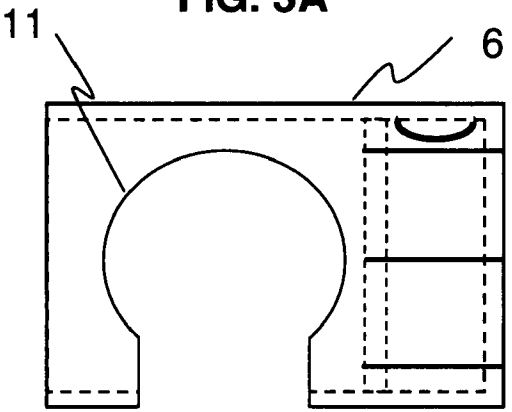
FIG. 3A shows an embodiment of the alignment assembly, 6, that orients the opening of the clip, 12, perpendicular to the axis of the angle-indicator, 8.
Figure 3B:
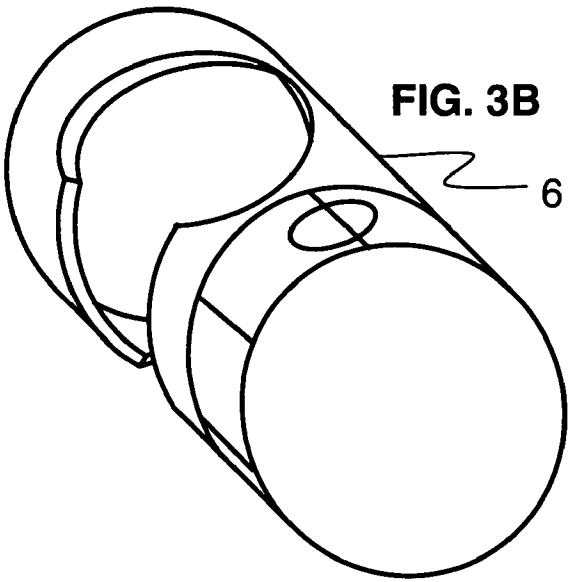
FIG. 3B is a perspective view of the alignment assembly, 6, depicted in FIG. 3A.

FIG. 3B is a perspective view of the alignment assembly, 6, depicted in FIG. 3A.

Figure 3C:
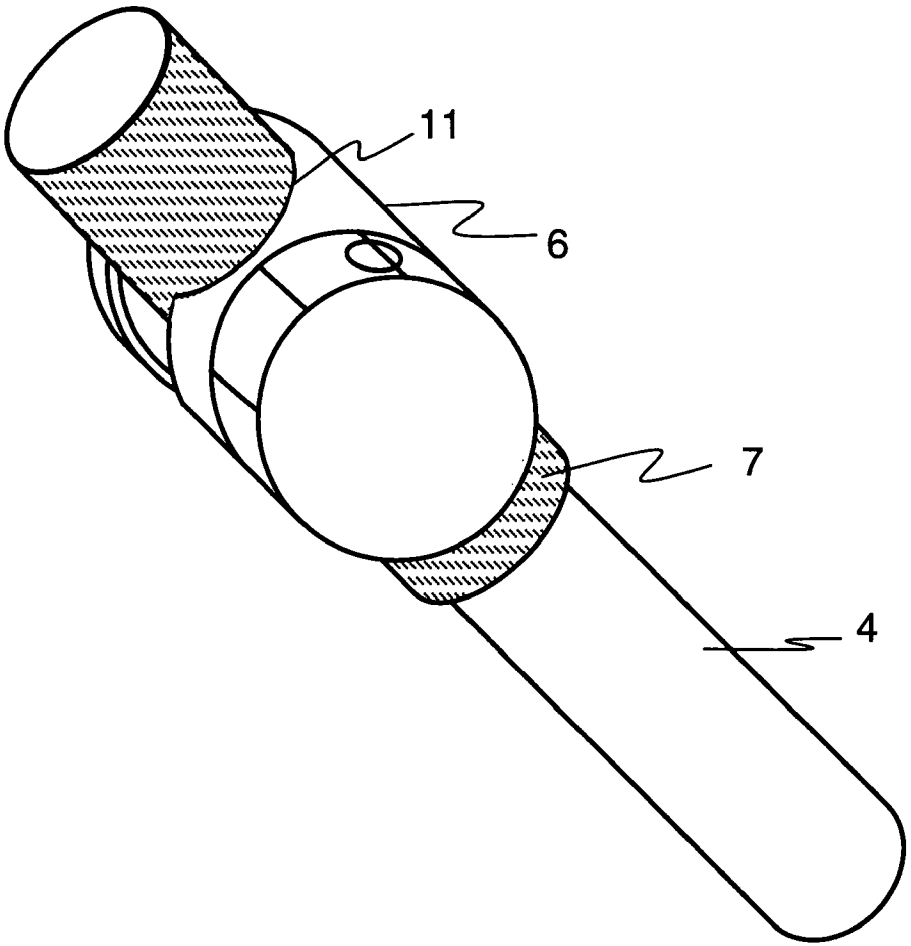
FIG. 3C shows the alignment assembly, 6, drawn in FIG. 3B mounted on a golf club.

FIG. 3C shows the alignment assembly, 6, drawn in FIG. 3B mounted on the golf club grip, 7. This is the preferred mounting arrangement. Although this embodiment permits the alignment assembly, 6, to be mounted to the shaft, 4, mounting the alignment assembly, 6, on the grip, 7, provides two significant advantages. First, current Professional Golfers Association rules prohibit attaching anything to the golf club, other than the grip, 7, during competitive play. Mounting the alignment assembly, 6, on the grip makes the alignment assembly a part of the grip, and hence legal in competitive play. Second, because the grip, 7, is made of rubber-like material, the coefficient of friction between the alignment assembly, 6, and the grip, 7, is higher than the coefficient of friction between the alignment assembly, 6, and the shaft, 4. This higher coefficient of friction between the alignment assembly, 6 and the grip, 7, results in more secure connections.

Figure 4B:
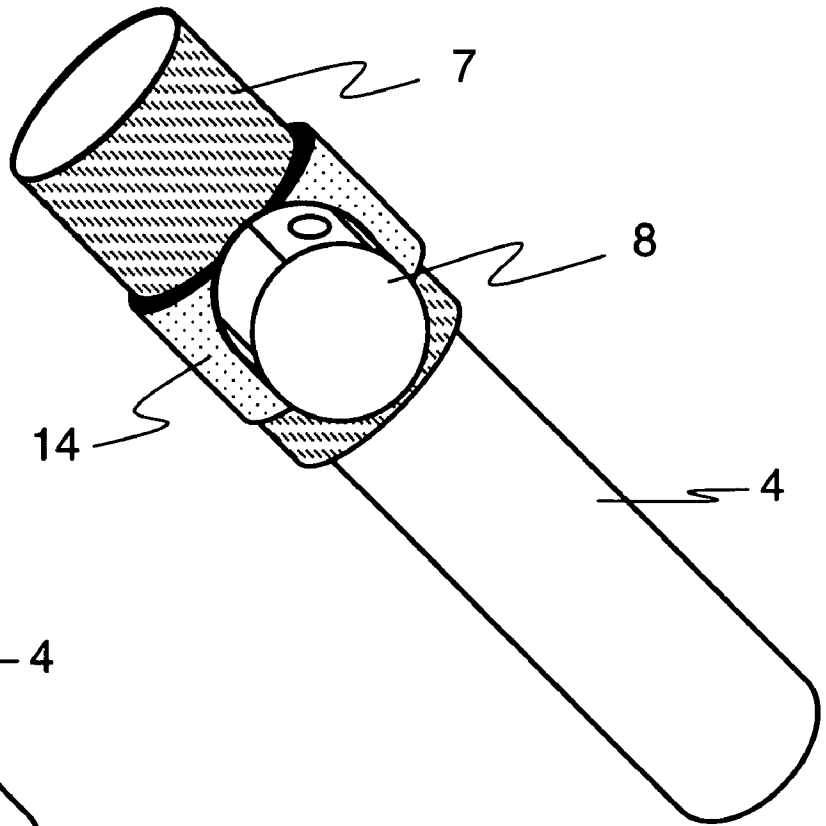
FIG. 4B shows an embodiment of the angle-indicator, 8, attached to the golf club grip, 7, by means of a fabric hook-and-loop fastener, such as Velcro, 13.
Figure 4A:
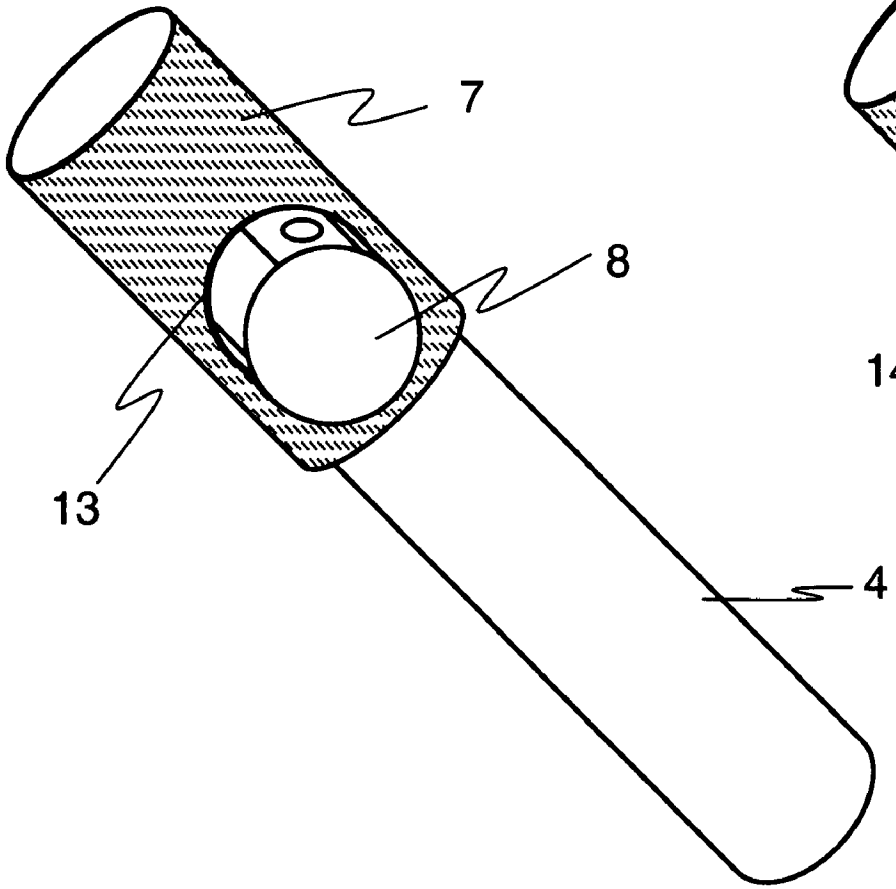
FIG. 4A shows an embodiment of the angle-indicator, 8, bonded directly to the golf club grip, 7.

There are numerous ways of mounting the alignment assembly to the golf club, including using mechanical latches, plastic ties, tape, and adhesives. FIG. 4A shows an embodiment of the angle indicator, 8, bonded directly to the golf club grip, 7, using a bonding agent, 12. This mounting arrangement securely attaches the angle indicator, 8, to the grip, 7, minimizes both size and costs, and defeats any arguments that the angle indicator, 8, is not a part of the grip, 7. The disadvantages of this embodiment are that the attachment is permanent, and golfers must purchase a different angle indicator, 8, for each club. FIG. 4B addresses these drawbacks by employing a fabric hook-and-loop fastener, such as Velcro, 13, to attach the angle alignment indicator, 8, to the grip, 7, or the shaft, 4.

FIG. 2B is a perspective view of the alignment assembly, 6, depicted in FIG. 2A.

FIG. 2C shows the alignment assembly, 6, drawn in FIG. 2B mounted on a golf club.

FIG. 3A shows an embodiment of the alignment assembly, 6, that orients the opening of the clip, 12, perpendicular to the axis of the angle-indicator, 8.

FIG. 3B is a perspective view of the alignment assembly, 6, depicted in FIG. 3A.

FIG. 3C shows the alignment assembly, 6, drawn in FIG. 3B mounted on a golf club.

FIG. 4A shows an embodiment of the angle-indicator, 8, bonded directly to the golf club grip, 7.

FIG. 4B shows an embodiment of the angle-indicator, 8, attached to the golf club grip, 7, by means of a fabric hook-and-loop fastener, such as Velcro, 13.

Numerous modifications to and alternative embodiments of the present invention will be apparent to those skilled in the art in view of the foregoing description. Accordingly, this description is to be construed as illustrative only and is for the purpose of teaching those skilled in the art the best modes of carrying out the invention. Details of the system may be varied substantially without departing from the spirit of the invention and the exclusive use of all modifications which come within the scope of the appended claims is reserved.

What I claim as my invention is:

1. An apparatus that enables a golfer to more consistently achieve a desired angle between a golf club shaft and the horizontal prior to initiating a golf swing, the apparatus comprising, in combination:

a golf club comprising a golf club shaft having an outside diameter; said shaft including a grip portion at one end and a golf club head at an opposite end of said shaft;

an angle indicating device comprising a fluid-filled curved bubble level containing a bubble and having markings along its circumferential edge corresponding to a plurality of different angles between the golf club shaft and the horizontal;

a flexible clip having an inside diameter for removably securing the angle indicating device to a position on the golf club shaft or the grip portion; said flexible clip enabling the angle indicating device to be moved along said golf club shaft or said grip portion until said flexible clip reaches a position wherein the outside diameter of either the golf club shaft or the grip portion exceeds the inside diameter of the flexible clip, whereby the flexible clip is securely engaged with the golf club shaft or the grip portion;

said angle indicating device being secured to said flexible clip and arranged with respect to said flexible clip such that the curved bubble level is both curved downward toward the horizontal when the flexible clip is attached to either the grip portion or the golf club shaft and further wherein said curved bubble level is viewable from the grip portion end of the golf club in a normal address position prior to a golf swing; the downward curve of the bubble level enabling the bubble to move along the arc of the curved bubble level in concert with the angle that the shaft of the golf club makes with the horizontal; whereby the bubble moves within the fluid chamber in response to different angles that the angle indicator makes with the horizontal as the shaft is moved upwardly or downwardly with respect to the horizontal.

* * * * *